United States Patent [19]

Ozawa

[11] Patent Number: 5,044,891

[45] Date of Patent: Sep. 3, 1991

[54] VARIABLE DISPLACEMENT DIAPHRAGM PUMP

[75] Inventor: Ken Ozawa, Quincy, Wash.

[73] Assignee: Ozawa R&D, Inc., Portland, Oreg.

[21] Appl. No.: 393,636

[22] Filed: Aug. 14, 1989

Related U.S. Application Data

[63] Continuation of Ser. No. 142,537, Jan. 11, 1988, Pat. No. 4,856,966.

[51] Int. Cl.[5] ..... F04B 49/00

[52] U.S. Cl. ..... 417/214; 417/413; 92/13.2; 92/84

[58] Field of Search ..... 417/214, 273, 413; 92/13.2, 13.6, 13.8, 60.5, 64, 153, 13.4, 13, 100, 101, 98 R, 98 D, 84

[56] References Cited

U.S. PATENT DOCUMENTS

| | | | |
|---|---|---|---|
| 939,656 | 11/1909 | Bassett | 92/13.6 |
| 1,319,857 | 10/1919 | Edholm | 92/13.7 |
| 1,610,950 | 12/1926 | Johnston | 92/48 |
| 1,871,040 | 8/1932 | Carter | 92/84 |
| 1,914,141 | 6/1933 | Lundin | 417/273 |
| 2,382,452 | 8/1945 | Svenson | 417/273 |
| 2,543,796 | 3/1951 | McGee | 417/273 |
| 2,712,793 | 7/1955 | Holm | 103/148 |
| 2,948,221 | 8/1960 | Carver | 103/37 |
| 3,288,071 | 11/1966 | Anderson | 103/38 |
| 3,375,972 | 4/1968 | Raufeisen | 230/172 |
| 3,712,758 | 1/1973 | Lech et al. | 417/214 |
| 3,733,148 | 5/1973 | Goodale | 417/214 |
| 3,769,879 | 11/1973 | Lofquist, Jr. | 84/92 |
| 3,771,911 | 11/1973 | Turci | 417/413 |
| 3,839,946 | 10/1974 | Paget | 92/153 |
| 3,910,723 | 10/1975 | Bonin | 417/214 |
| 4,021,154 | 5/1977 | Gorchakov et al. | 417/218 |
| 4,080,107 | 3/1978 | Ferrentino | 417/53 |
| 4,167,896 | 9/1979 | Clements | 92/13.2 |
| 4,368,010 | 1/1983 | Kohlbauer et al. | 417/271 |
| 4,830,232 | 5/1989 | Greenberg et al. | 92/100 |

FOREIGN PATENT DOCUMENTS

| | | | |
|---|---|---|---|
| 3027314 | 2/1982 | Fed. Rep. of Germany | 417/413 |
| 113588 | 7/1983 | Japan | 417/214 |

OTHER PUBLICATIONS

Bermad brochure, "Water Power Fertilizer Injector".

CDS Ag. Industries, Inc. brochure, "E-Z Meter Pump," 11/85.

Crane Chempump brochure, "A Complete Line of Diaphragm Metering Pumps from Chem/Meter" (Bulletin No. 10), 12/82.

Hydroflo Corporation brochure, "Hydromyte-D Series 400 Metering Pumps for the Agri-Industry" (Bulletin No. 429).

Hydroflo Corporation, "Cheminjector-D Series 1000 Diaphragm Metering Pumps" (Bulletin Nos. 918-1, 1000.60, 1000.61).

Hydroflo Corporation brochure, "Cheminjector-D Series 2000 Diaphragm Metering Pumps" (Bulletin No. GB634-3).

Hydroflo Corporation brochure, "12 Ways that Hydroflo Delivers!" (Form 1000.30).

Hydroflo Corporation brochure, "A Dozen Ways that Hydroflo Delivers!" (Form 18).

(List continued on next page.)

*Primary Examiner*—Leonard E. Smith

*Assistant Examiner*—John A. Savio, III

*Attorney, Agent, or Firm*—Christensen, O'Connor, Johnson & Kindness

[57] ABSTRACT

A power source (14) rotates an eccentric (20) engaged within the center of a relatively large drive roller (22) to rotate the drive roller while simultaneously orbiting the center of the drive roller about a circular path so as to cyclically advance and retract from piston assemblies (24) located within pump assemblies (16*a*-16*d*). Rotation of the eccentric (20) causes each piston assembly (24) to cyclically advance against and retract from a flexible diaphragm (26) to cause fluid entering the pump assembly to be forced out under pressure. Each diaphragm (26) is "backed" by a spring-loaded support (27) that resiliently pushes against the side of the diaphragm opposite the piston assembly.

53 Claims, 4 Drawing Sheets

OTHER PUBLICATIONS

Inject-O-Meter Manufacturing Co., Inc. brochure, "Proportioning Pumps Built Especially for the Irrigation Farmer".

Inject-O-Meter Manufacturing Co., Inc. brochure, "Series KM 200-230 Diaphragm Pumps" (Form KM 200-203 1).

Madden brochure, "Metriflow Series Diaphragm Metering Pumps" (Form No. M300C).

Milton Roy Company brochure, "Instruction Manual, mRoy Controlled Volume Pump" (102-9856-999A).

Neptune Chemical Pump Company Bulletin CP-22-0-82, "Series 200 Chemical Proportioning Pump," 2/82.

Neptune Chemical Pump Company brochure, "Neptune Series 500 and 500-A 'dia-PUMPS' are Products of Innovative Design and Quality Workmanship Which Offer Long-Term Reliability," 1983.

Neptune Chemical Pump Company Bullet TP-85, "Series 500 Tubular Diaphragm Pumps," 2/85.

Neptune Chemical Pump Company Bulletin DP-20-00-85, "Diapump Series 600 High-Pressure-High-Diaphragm Pumps," Mar. 1983.

Neptune Chemical Pump Company Bulletin LVF-1010, "N FEEDER' Low-Volume Solenoid--Driven and Motor-Driven Mechanically Actuated Diaphragm Pumps," 1985.

Raguse and Co., Inc. brochure, "Don't Buy Just a Pump . . . Buy Capacity," 1979.

10
31
36
94
92
160
30
28
154
16b
102
100
18b
16a
18a
90
14
40
44
42
16d
18d
12

VARIABLE DISPLACEMENT DIAPHRAGM PUMP

This is a continuation of my prior application Ser. No. 142,537, filed Jan. 11, 1988 now U.S. Pat. No. 4,856,966.

TECHNICAL FIELD

The present invention relates to fluid pumps, and in particular to variable displacement diaphragm pumps of high reliability in which the volumetric output can be very finely metered.

BACKGROUND OF THE INVENTION

There are numerous situations in which it is necessary to supply fluids in small, very precise flow rates. For example, in agriculture it is common to utilize irrigation systems in which relatively small amounts of liquid fertilizers, pesticides or herbicides are added to the water. Often these chemicals are added at volumetric flow rates as little as one-half gallon per hour, whereas the volumetric flow rate of the irrigation water may be several hundred gallons per minute. Also, in the production of pharmaceutical products, the active ingredient may compose a fraction of one percent of the total weight or volume of the product. It is highly important that the proportion of the active ingredient be very accurately metered during the production of the pharmaceutical. As another example, in food processing certain ingredients, such as dyes, fixatives, preservatives or spices comprise a small fraction of the total food product. Again, in these situations it is critical that these particular ingredients be very accurately metered during the food production process.

In one typical type of system commonly used in agriculture, an electric or internal combustion motor is coupled to the input shaft of a separate, speed-reducing gearbox. A variable throw crank is mounted on the output shaft of the gearbox which is disposed at 90° from the input shaft. A connecting rod interconnects the crank with an elongated piston to reciprocate the distal or free end of a piston within a pumping chamber. Check valves are placed in the inlet and outlet ports of the pumping chamber ostensibly to prevent the liquid in the pumping chamber from leaking back through the inlet port as the piston is advancing into the pumping chamber to force the liquid out through the outlet port and, conversely, to prevent the liquid from leaking back into the pumping chamber from the outlet port when the piston is being retracted to draw liquid into the pumping chamber through the inlet port. This type of pumping system suffers some significant drawbacks. These systems are typically composed of a menagerie of "off-the-shelf" components which are not well matched in geometric configuration nor relative size or capacities. As such, it is necessary to "oversize" many of these components, resulting in not only a larger, heavier and more expensive system than actually required for the desired function, but also requiring a high level of energy consumption relative to the volume and pressure of the liquid being pumped. In addition, the corrosive nature of the liquids being pumped often causes premature failure of the pump mechanism. Also, the system typically requires frequent lubrication and maintenance, which may not always be performed in the agricultural setting. Further, the mechanism for changing the stoke of the crankshaft typically cannot be adjusted in a precise manner so that often the fertilizer, pesticide or herbicide is applied at either too high or too low of a rate.

Because of their low volumetric flow rates, diaphragm-type pumps also are utilized in irrigation, food processing and pharmaceutical production to supply liquid ingredients at small flow rates. In one type of diaphragm pump, the diaphragm is flexed back and forth by a reciprocating plunger having its forward end secured to the center of the diaphragm. Examples of such diaphragm pumps are disclosed by U.S. Pat. Nos. 3,288,071 and 4,368,010. These types of diaphragm pumps suffer from several serious drawbacks. For instance, the mechanism for varying the flow rate of the pumps often is not finely adjusted enough to control the supply of liquids as accurately as required. Also, in many known diaphragm pump designs, if the diaphragm ruptures, the liquid being pumped mixes with the pump lubricant located on the other side of the diaphragm and thus becomes contaminated. A further common drawback of known diaphragm pumps is that during normal operation the components of the pump are subjected to relatively high stress loads resulting in failures or unreliable operation after a relatively short time period.

In a second known type of diaphragm pump, the diaphragm is actuated by hydraulic fluid which pushes against the side of the diaphragm opposite the liquid being pumped. The hydraulic fluid is cyclically pressurized by a reciprocating piston. In addition to the shortcomings of plunger-actuated diaphragm pumps discussed above, in hydraulically powered diaphragm pumps, if the diaphragm leaks or ruptures, the higher pressure of the hydraulic driving fluid causes the fluid to be injected into the liquid being pumped, thus contaminating the liquid. Further, the cyclical pressurizing of the hydraulic driving fluid results in the generation of large amounts of heat causing the temperature of the fluid to rise to high levels, often leading to premature failure of the pump, including the diaphragm, which typically is one of the more "fragile" components of a diaphragm pump.

SUMMARY OF THE INVENTION

The foregoing drawbacks of known diaphragm pumps are addressed by the present invention wherein a pump is composed of a housing forming an internal chamber with a flexible diaphragm extending across the internal chamber to divide it into a pumping chamber and a piston chamber. Inlet and outlet openings direct fluid into and out of the pumping chamber. A diaphragm support is slidably housed within the pumping chamber and resiliently urged against substantially the entire adjacent face of the diaphragm. A reciprocating piston is located in the piston chamber to cyclically push against the opposite face of the diaphragm in opposition to the diaphragm support. The piston is reciprocated back and forth by a circular drive member, the outer rim portion of which contacts against the piston. A power source advances and retracts the circular drive member toward and away from the piston while at the same time rotating the drive member so that the drive member makes rolling contact with the piston to minimize stress loads and wear on the drive member and piston. Also, since the drive member continues to rotate when it is retracted away from the piston, a different section of the drive member is placed in contact with the piston during the next cycle in which the drive member pushes the piston forwardly against the diaphragm.

In accordance with another aspect of the present invention, the circular drive member is powered by an eccentric integrally formed with a support shaft. The drive member rotates about its central axis, while at the same time the central axis of the drive member orbits around the rotational center of the support shaft. Antifriction bearings are interposed between the eccentric and the central portion of the drive member.

In a further aspect of the present invention, the flow rate of the diaphragm pump is selectively changed by varying the stroke of the pump with an adjustable system that controls the retracted position of the piston. This adjustable system includes a ramp surface associated with the piston disposed at an acute angle relative to the plane of the diaphragm. A rotatably adjustable stop member bears against the ramp surface. The adjustable stop member advances towards and retracts from the stop member at an acute angle from the plane of the ramp surface so that the incremental change in the stroke of the piston is relatively small in comparison to the linear distance that the adjustable stop member is advanced or retracted.

In an additional aspect of the present invention, the piston includes an enlarged head having a forward portion facing the diaphragm and a rearward portion facing away from the diaphragm. The ramp surface of the stroke adjustment system is located on the rearward portion of the piston head, which rearward portion is frustoconically shaped so that the entire rearward portion of the piston constitutes the ramp surface.

In accordance with yet another aspect of the present invention, the piston includes a head section and a stem section that are slidably engaged with each other. A preloaded spring or other resilient member is interposed between the head and the stem sections of the piston to allow the stem section to move relative to the head section if the pump is "deadheaded" so that the head section is prevented from moving toward the diaphragm support.

BRIEF DESCRIPTION OF THE DRAWINGS

The details of typical embodiments of the present invention will be described in connection with the accompanying drawings, in which.

DETAILED DESCRIPTION

Figure 1:
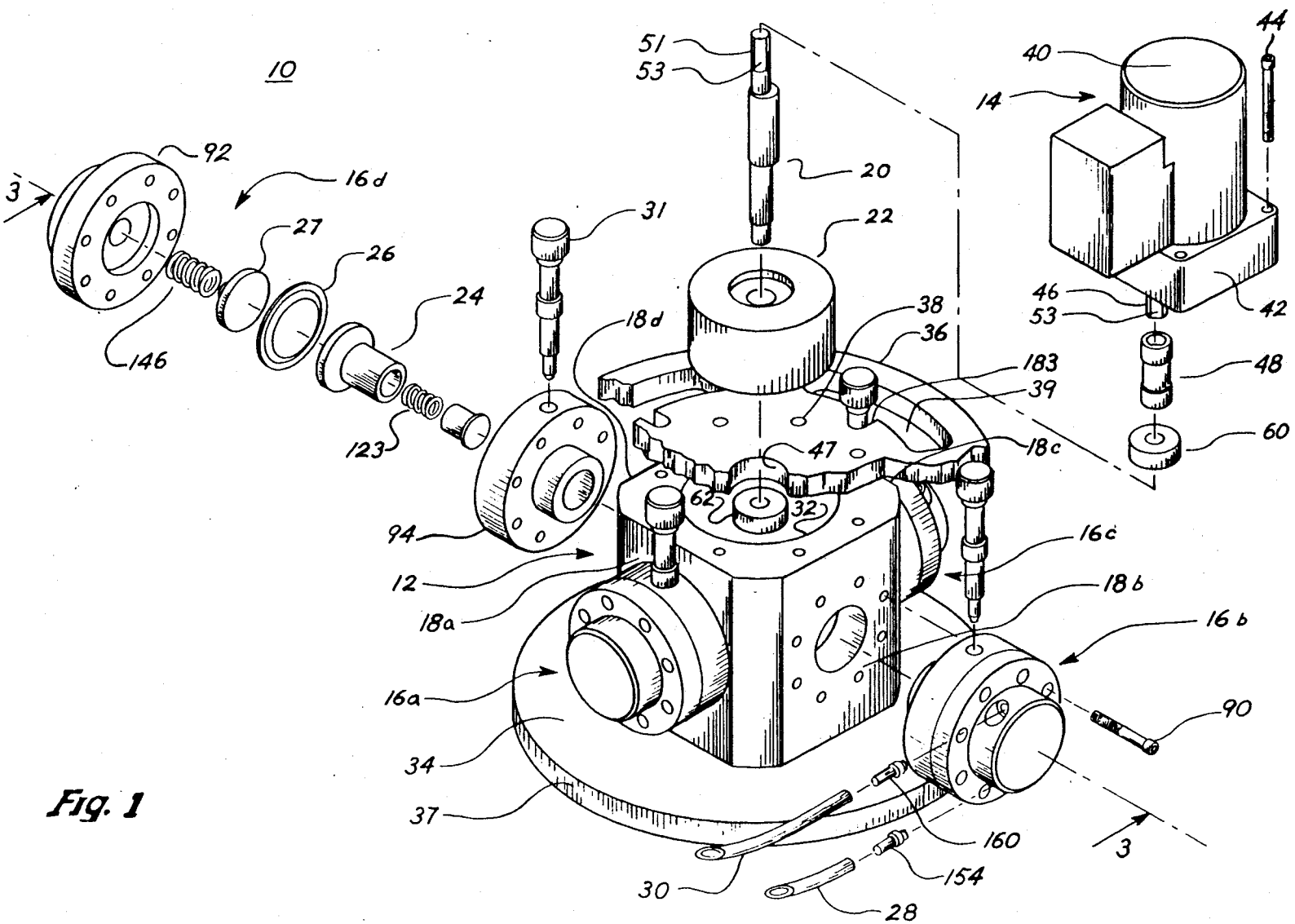
FIG. 1 is an exploded isometric view of a preferred embodiment of the present invention utilizing four diaphragm assemblies driven by a single power source.

Referring initially to FIG. 1, a variable displacement diaphragm pump 10 constructed in accordance with the present invention is illustrated as including a power source 14 mounted on the top of a rectangularly-shaped drive housing 12 to power pump assemblies 16*a*, 16*b*, 16*c* and 16*d* mounted on the four sidewalls 18*a*, 18*b*, 18*c* and 18*d* of the drive housing. The power source 14 rotates an eccentric 20 engaged with the center of a drive roller 22 to rotate the drive roller while simultaneously orbiting the center of the drive roller about a circular path to cause the drive roller to cyclically advance against and retract from a piston assembly 24 located within each of the pump assemblies 16*a*–16*d*. The piston assembly 24 in turn cyclically pushes against a diaphragm 26 in opposition to a diaphragm support 27 that resiliently bears against the opposite side of the diaphragm. The diaphragm is flexed by the advancing piston assembly 24 thereby causing fluid entering the pump assembly through inlet line 28 to be forced out under pressure through outlet line 30. The stroke of the piston assembly 24 and, thus, volumetric capacity of the pump 10, is varied by an adjustable stop 31 that controls the retracted position of the piston assembly.

Figure 2:
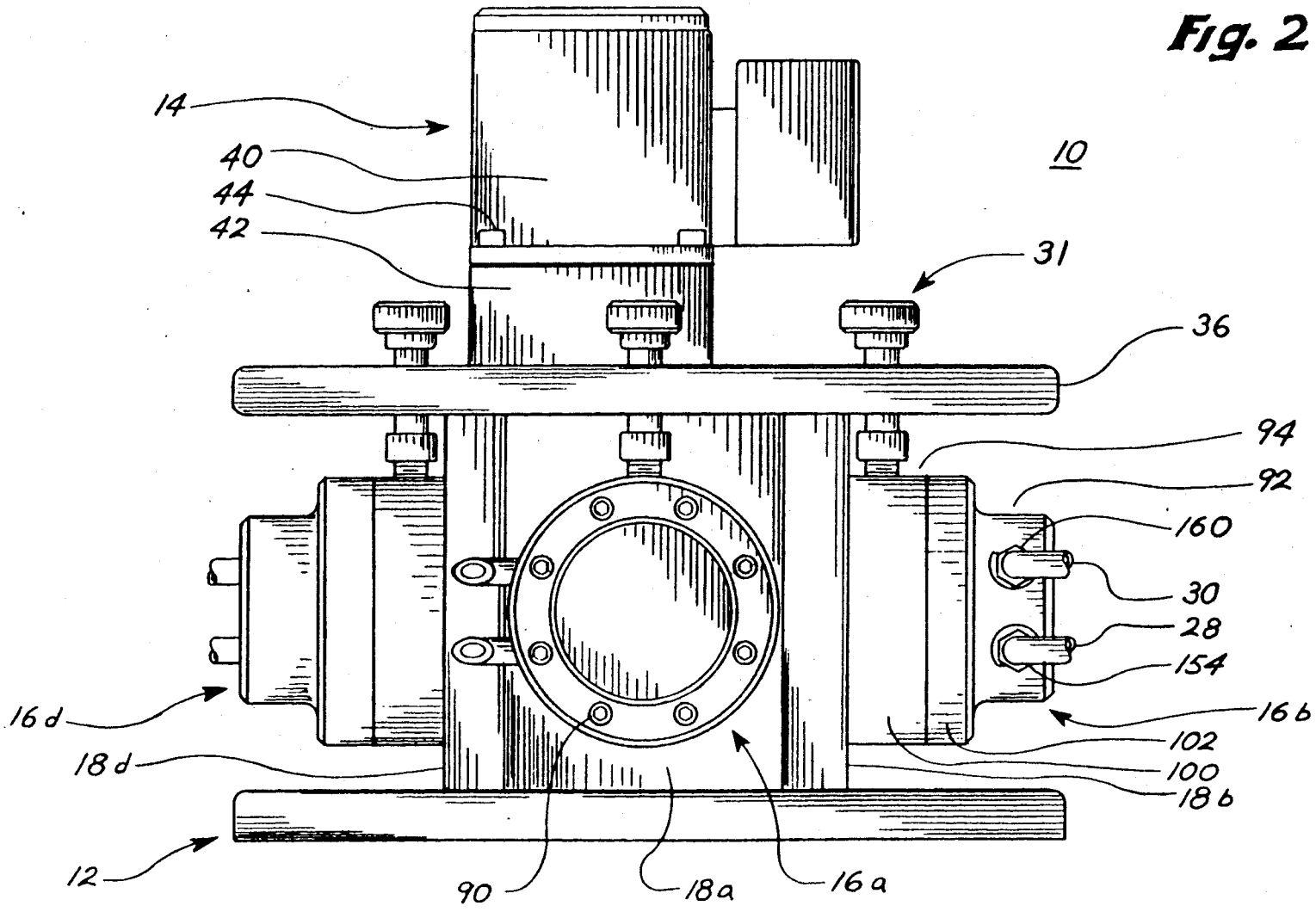
FIG. 2 is a side elevational view of the diaphragm pump shown in FIG. 1.
Figure 3:
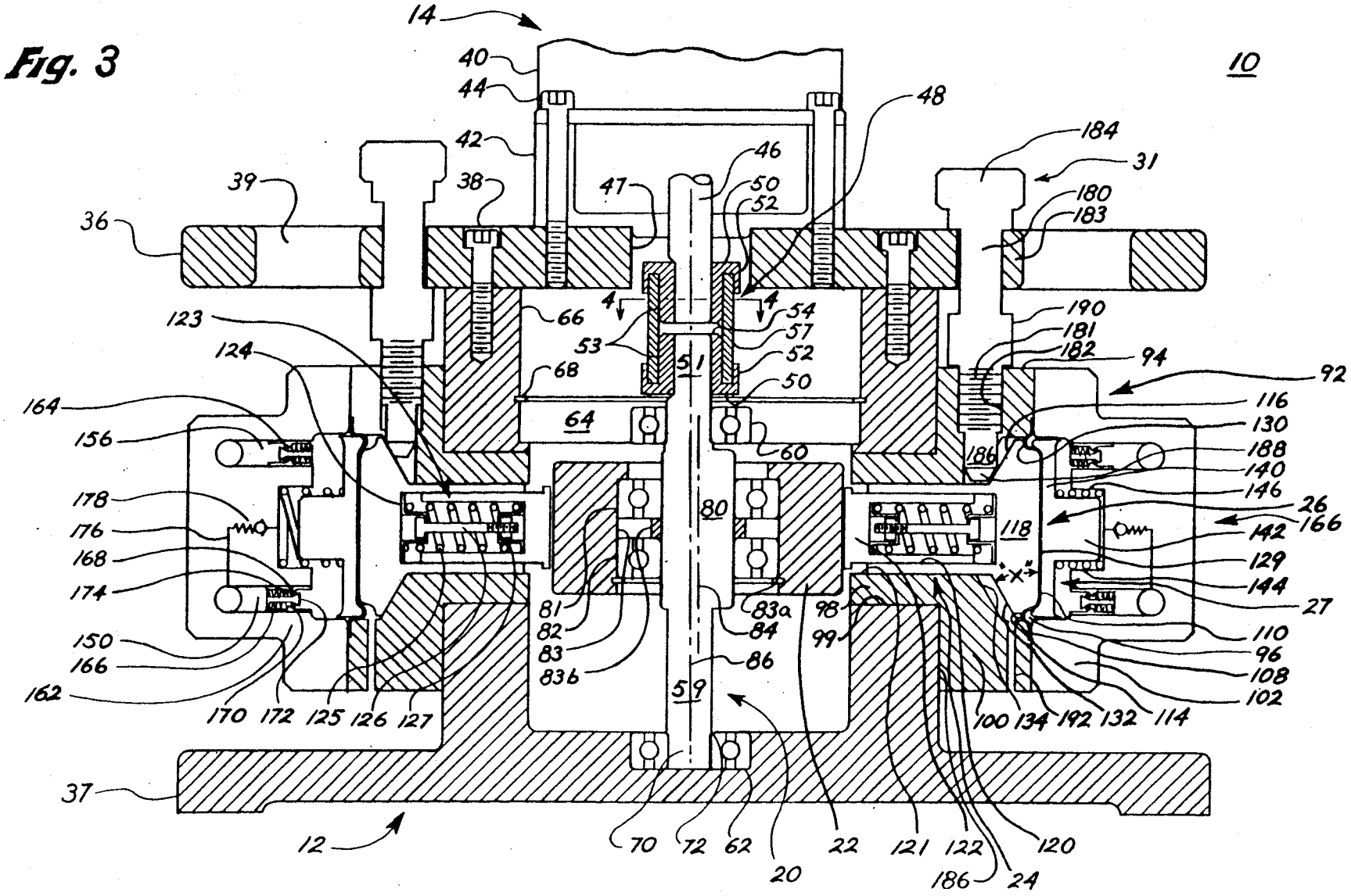
FIG. 3 is a cross-sectional view of the diaphragm pump shown in FIG. 1 taken substantially along lines 3—3 thereof to specifically illustrate the construction of the drive systems and diaphragm assembly; and, FIG. 4 is a fragmentary, cross-sectional view taken substantially along lines 4—4 of FIG. 3.

Next discussing the foregoing components of the present invention in greater detail, as shown in FIGS. 1–3, drive housing 12 generally in the shape of a hollow cube with the interior cavity 32 of the housing being sized to receive the drive roller 22. The drive housing 12 is illustrated as including a flat, circular base portion 34 that closes off the bottom of the housing and gives the pump 10 stability, especially if it is used as a portable unit. The base 34 is illustrated as being integrally formed with the housing sidewalls 18*a*–18*d*; however, the base can be fabricated separately and then joined to the housing sidewalls by any convenient method, such as by the use of threaded fasteners or weldments, not shown.

A circular cover 36 is used to close off the top of the housing 12. The cover 36 is secured to the housing 12 with threaded fasteners, such as capscrews 38, that extend through clearance holes formed in the cover to engage with aligned, tapped blind holes extending downwardly into the upper edge portions of the housing walls 18*a*–18*d*. Ideally, the diameters of the housing base portion 37 and the cover 36 are sized to extend outwardly of the distal ends of the pump assemblies 16*a*–16*d*, thereby to afford protection for the pump assemblies. Also ideally, arcuate, oblong openings or slots 39 are located about the circumference of the cover close enough to the outer edge of the cover to serve as hand reception openings for use in conveniently lifting or moving the pump 10.

It is to be understood that the drive housing 12 may be constructed in other configurations to accommodate the purpose for which and the location at which the pump 10 is utilized. For instance, if the pump 10 is mounted on a frame or a machine, it may be desirable to provide mounting holes, not shown, in the base 34, or to replace the base with mounting flanges, not shown, having holes formed therein, not shown, through which bolts or other types of fastener members may be used to mount the pump.

Ideally, the drive housing 12 and associated base 34 and cover 36 are constructed from a high strength, lightweight material such as nylon or other type of plastic. As discussed below, the high efficiency and low operating temperature of the present invention enable these components to be formed from plastic materials. One advance of utilizing plastic materials for these components is that they can be efficiently and economically molded by known techniques. However, if desired, these components can be made from metallic materials without departing from the spirit or scope of the present invention.

Continuing to refer specifically to FIGS. 1 and 2, the power source 14 includes a drive motor 40 having an integral, speed-reducing gear drive 42. The drive motor and gear drive are mounted on the housing cover 36 by any convenient method, such as by threaded fasteners 44 extending through clearance openings formed in the gear drive to engage within aligned tapped holes formed in the cover. A powered output shaft 46 extends downwardly from the gear drive 42, through a central hole 47 formed in the cover 36, to rotate the drive roller 22.

Figure 4:
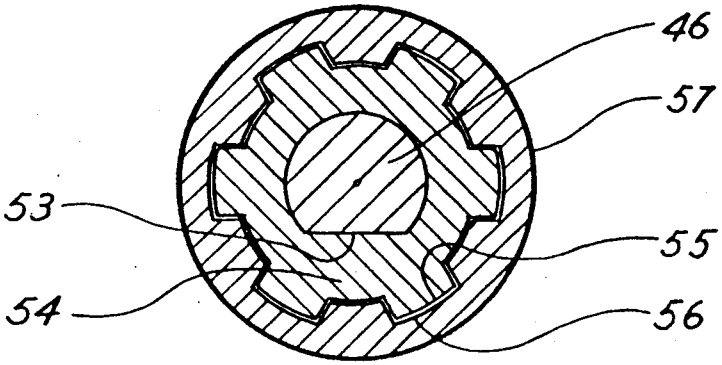

The output shaft 46 is coupled to the eccentric 20 by a coupling assembly 48 composed of a pair of coupling collars 50 engaged with the output shaft and with the adjacent upper end 51 of the eccentric 20. Each of the coupling collars 50 includes a circular end wall 52 having a central opening for receiving the output shaft 46 or the eccentric upper end 51. Both the output shaft and the eccentric upper end are formed with a flat 53, rather than being entirely circular in cross section, to engage within correspondingly-shaped central openings formed in the end walls 52. As will be appreciated, the flats 53 enable torque to be transmitted between the coupling collars 50 and the output shaft 46 and the eccentric upper end 51. The coupling collars 50 also include circular shank portions 54 extending from the end walls 52 toward the opposite coupling collar. As most clearly shown in FIG. 4, the outer circumference of each shank 54 is formed with longitudinal serrations 55 to closely and slidably engage with corresponding serrations 56 formed in the inside surface of a circular coupling tube 57, which engages over the shank portions 54 of the coupling collars 50. As shown in FIG. 3, the ends of the coupling tube 57 bear against the end walls 52 of the coupling collars 50, which end walls extend diametrically outwardly from the shank portions 54.

It will be appreciated that by the foregoing construction, the coupling assembly 48 not only enables the power source 14 to be quickly and conveniently coupled to the drive roller 52, but also the coupling assembly accommodates a certain amount of misalignment between the gear drive output shaft 46 and the upper end 51 of the eccentric 20. Nonetheless, it is to be understood that the output shaft 46 and the eccentric 20 may be coupled together to transmit torque therebetween by numerous other types of couplings without departing from the spirit or scope of the present invention.

Ideally, the coupling assembly 48 is composed of a plastic material which eliminates the need for periodic lubrication or other maintenance. This is consistent with a major goal of the present invention, i.e., to provide an extremely reliable, long-life diaphragm pump that requires essentially no maintenance.

The eccentric 20 is antifrictionally mounted within the interior of the drive housing 12 by roller bearings 60 and 62 that receive the upper and lower ends of the support shaft portion 59 of the eccentric. The roller bearing 60 is snugly engaged within a counterbore formed in the center of a circular bearing carrier 64, which is disposed within a counterbore 66 extending downwardly from the top of the housing to seat on a shoulder formed at the counterbore. The bearing carrier 64 is retained against the shoulder by a snap ring 68 that engages within a close-fitting snap ring groove formed in the counterbore 66 to bear against the upper surface of the support plate. The lower end of the eccentric support shaft 59 is reduced in diameter at 70 to engage within the inner race of the bearing 62 which is seated within a blind bore formed in baseplate 34. A shoulder 72 defined by the intersection of the reduced diameter portion 70 and the full diameter of the support shaft 59 serves to axially restrain the eccentric 20 and thus also the drive roller 22.

It is to be understood that the electric motor 40 may be replaced by other types of power units, such as a hydraulic motor, a small gas engine or an auxiliary drive from the larger internal combustion engine without departing from the scope of the present invention. Depending upon the rotational speeds of these alternative power sources, it may or may not be necessary to utilize a speed reducer, such as the gear drive 42. It is also to be understood that the power source 14 and the pump assemblies **16*a*–16*d* may be located in other relative positions about the housing 12 than are illustrated in FIGS. 1–3**.

Referring specifically to FIG. 3, the drive roller 22 is mounted on an enlarged, circular, offset portion 80 of the eccentric 20 through the intermediacy of a pair of spaced-apart upper and lower roller bearings 81 and 82 engaged within a central counterbore 83 formed in the drive roller. The lower roller bearing 82 is retained within the counterbore 83 by a snap ring **83*a* engaged within a groove formed in the counterbore. A circular spacer 83*b* is disposed between the two bearings to maintain them spaced apart from each other. The drive roller 22, which serves as an eccentric strap for the eccentric 20, is formed in a disk shape having a substantial width which provides a relatively large bearing surface for pushing against the adjacent ends of the piston assemblies 24. It will be appreciated that because the central axis 84 of the offset portion 80 of the eccentric 20 is offset from the rotational axis 86 of the support shaft portion 59 and the output shaft 46, the center of the drive roller 22 (defined by axis 84) orbits around a circular path while the drive roller is being simultaneously rotated by the output shaft 46. The center of this circular path is defined by axis 86**.

Next referring to both FIGS. 1 and 3, the pump assembly **16*a* will be described in detail with the understanding that the pump assemblies 16*b*, 16*c*, and 16*d* are similarly constructed. The pump assembly 16*a* constitutes a discrete subassembly which may be preassembled prior to being mounted on the drive housing 12 through the use of threaded fasteners, such as bolts 90, that extend through clearance holes formed in the pump assembly to engage within aligned threaded openings formed in the adjacent wall of the drive housing. The pump assembly 16*a* is composed of a housing outer member 92 and a housing inner member 94 that cooperatively define an internal, cylindrically-shaped diaphragm chamber 96. Both the outer and inner housing members 92 and 94 are generally circular in shape. The housing inner member 94 is formed with a pilot hub 98 that snugly fits within a circular opening 99 formed in the adjacent wall 18*a* of the housing 12, thereby positioning the pump assembly 16*a* so that the piston assembly 24 is in alignment with the outer circumference of the drive roller 22. The housing inner member 94 also includes a larger body or flange portion 100 that overlaps the exterior of housing wall 18*a* and mates with the abutting enlarged flange portion 102 of the housing outer member 92**.

The pump assembly **16*a* also includes a diaphragm 26 having an annular outer rim portion 108 that is sandwiched between the mating faces of the outer and inner pump housing members 92 and 94. The diaphragm 26 also has a central, planar, circular portion 110 that spans across the internal diaphragm chamber 96 to divide the chamber into a piston chamber within which the piston assembly 24 is disposed and a pumping chamber within which the diaphragm support member 27 is disposed, as discussed more fully below. The diaphragm 26 also includes a formed ridge portion 114 extending around the diaphragm between the central circular portion 110 and the outer rim portion 108. As shown in FIG. 3, the ridge portion 114 is generally semicircular in cross section to extend from the plane defined by the central and flange portions of the diaphragm in the direction toward piston assembly 24. The ridge portion 114 enhances the flexibility of diaphragm 26 to allow the central portion 110 to be freely flexed back and forth by the reciprocating piston assembly 24. Preferably the diaphragm 26** is constructed from a high strength, resilient material which is resistant to degradation by acidic or caustic chemicals and fluids. Materials meeting these criteria include, for instance, nylon, polypropylene, Teflon ®, natural and synthetic rubber and coated fabrics.

As perhaps most clearly shown in FIG. 3, the piston assembly 24 is composed of a piston 116 having an enlarged, generally circular head 118 and a rearwardly extending hollow skirt 120 engaged within a close fitting piston bore 121 formed in the housing inner member 94. The inside diameter of the skirt 120 is sized to closely and slidably receive therein a circular stem 122. A compression spring assembly 123 is disposed within the skirt 120 to bear against the adjacent end of the stem and against the back side of the piston head 122. The compression spring assembly 123 includes a pair of dished end plates 124 that are loaded against the opposite ends of compression spring 125 by a hardware member, such as capscrew 126, extending through clearance holes formed in the centers of the two end plates 124 to engage with a nut 127. The end plates 124 function to preload the compression spring 125 so that the spring operates in its "effective range" when compressed by relative movement between the piston 116 and stem 122. Almost all compression springs that are nominally unloaded may be compressed a few thousandths of an inch by application of a relatively small force until the spring is sufficiently loaded to function at its effective spring rate. Since in the present invention the travel of pistons 116 may be through a very short distance during the operation of pump 10, unless the compression spring 125 is preloaded to its operating range, the travel distance of the piston 116 may be less than the distance that the stem 122 travels as it is loaded and unloaded by the rotating drive roller 22. It is to be understood that compression spring 125 may be preloaded by other methods without departing from the spirit or scope of the present invention. Moreover, the compression spring assembly 128 may be replaced by other types of resilient members, such as wave springs or finger springs. The primary purpose of the spring assembly 123 is to prevent damage to the components of the pump assembly **16*a* and the other components of the pump 10 if for some reason the pump assembly is "dead-headed" so that the piston 116 is prevented from advancing forwardly against the diaphragm 26. If this occurs, the spring 125 will compress to prevent the stem 122 to move towards the piston head 118** under the pushing load of the drive roller.

The piston head 118 is formed with a circular, flat, central face 129 which bears against the adjacent circular, central portion 110 of the diaphragm 26. The outer circumference of the piston head is shaped in the form of a forwardly directed, rounded shoulder 130 that corresponds to the contour of the formed ridge portion 114 of the diaphragm 26 to provide support for the ridge portion as the piston pushes against the diaphragm. The piston head 118 further includes a rearwardly facing, sloped shoulder 132 corresponding in shape to a frustoconically-shaped counterbore 134 that interconnects the piston bore 121 with the piston chamber portion of the pump housing inner member 94. As best shown in FIG. 3, the piston shoulder 132 is sloped at an acute angle "x" from the plane of the face 129 of the piston head 118, which slope is substantially the same as the slope of the housing counterbore 134.

Referring specifically to FIGS. 1 and 3, the pump assembly **16*a* also includes a diaphragm support 27 having an enlarged, circular head portion 140 that closely and slidably engages within the pumping chamber of the pump assembly. The head portion 140 includes a circular, substantially flat face corresponding to the face 129 of the piston head 118 to bear against the opposite side of the circular, central portion 110 of the diaphragm 26 opposite to the piston head 118. The head portion 140 also includes a curved outer rim projecting toward the rounded shoulder 130 of the piston head 118, which outer rim is contoured to match the curvature of the diaphragm ridge 114 and the shape of the piston head shoulder. It will be appreciated that the opposing faces of the diaphragm support 27 and the piston head 118 are sized and shaped to substantially fully overlie the entire diameter of the diaphragm 26**, thereby providing maximum support for the diaphragm resulting in the enhanced reliability of the diaphragm and the ability of the diaphragm to withstand relatively high pressures without premature failure.

The diaphragm support 27 also includes a central, reduced diameter stem 142 that extends outwardly from the central portion of the diaphragm support head portion 140 to extend within a blind bore 144 formed in the central portion of the pump outer housing member 92. A compression spring 146 is disposed within blind bore 144 and extends over the stem 142 to resiliently urge the diaphragm support 27 in the direction toward the piston assembly 24. The load applied to the diaphragm support 27 by the spring 146 is overcome each time the piston assembly 24 is advanced against the diaphragm 26 by the drive roller 22.

The pump outer housing member 92 is formed with a fluid inlet passageway 150 in fluid flow communication with the pumping chamber. Fluid is directed to passageway 150 by an inlet line 28 connected to a tapped opening formed in the passageway by a threaded fitting 154. A fluid outlet passageway 156 is also formed in the pump outer housing member 92 to direct the fluid from the pumping chamber to an outlet line 30 which is connected to a threaded outlet opening formed in the passageway by the use of a threaded fitting 160. A check valve 162 is disposed within inlet passageway 150 to permit fluid to flow only in the direction toward the pumping chamber and a second check valve 164 is disposed within the outlet passageway 156 to permit fluid to only flow out of the pumping chamber but not into the pumping chamber. The check valves 162 and 164 are designed to operate effective and efficiently in any orientation to positively close the valve when pressurized in one direction while quickly opening the valve when such pressure is removed and then permitting fluid to flow through the valve in a substantially unrestrictive manner. The valves 162 and 164 include a generally cylindrically-shaped housing 166 which is snugly disposed within the passageways 15 and 156. The housings 166 are formed with central shoulder portion 168 which serves as a backing for an O-ring 170, which forms a seal between the housing 166 and an enlarged head portion of a poppet 172. The poppet 172 is nominally seated against the O-ring by a compression spring 174 acting against the opposite side of the shoulder and the distal, reduced diameter end of the poppet. When fluid enters the valve 162 or 164 in the direction toward the poppet head, the opposite side of the poppet head seals tightly against the O-ring. When the fluid enters the poppet valves in the opposite direction, the poppet is pushed away from the O-ring 170 in opposition to the fairly nominal load applied to the poppet by the spring 174.

A pressure relief passageway 176 is schematically illustrated in FIG. 3 as interconnecting the pumping chamber (at the center of the blind bore 144) with the inlet passageway 150. A spring-loaded check valve 178 is disposed within the passageway 176 to permit fluid from flowing from the pumping chamber to the inlet passageway and not in the reverse direction. If the outlet line 30 becomes blocked or fluid is otherwise prevented from exiting the pump assembly, the pressurized fluid expelled by the diaphragm pump through the passageway 176 is recirculated through the pump assembly 16 to avoid damage to the pump assembly, and especially to the diaphragm 26. It will be appreciated that the use of passageway 176 and check valve 178 may likely eliminate the need for the compression spring assembly 123 discussed above, in which case the piston 116 and stem 122 may be constructed as a singular member.

It is to be appreciated that the fluid inlet and outlet lines 154 and 160 may be reversed from their locations shown in FIG. 2 so that the fluid being pumped enters the upper portion of the pumping chamber and exits from the lower portion of the pumping chamber. This may be important when pumping fluid mixtures having a solid phase which rapidly settles out from the liquid phase unless maintained in an agitated state. One example of such a mixture is salt brine having an excess of salt. To further assist the solid phase from settling out from the liquid phase, one of the other pump assemblies, i.e., pump assembly 16*b, c* or *d,* may be utilized to continually circulate the mixture in the tank in which the mixture is being stored.

It will also be appreciated that rather than locating the inlet and outlet lines 154 and 160 one above the other, the pump assemblies 16*a*–16*d* may be rotated 90 degrees from their locations shown in FIG. 2 so that such inlet and outlet lines are horizontally side-by-side to each other either beneath the underside of cover 36 or just above the upper surface of the housing base 37. In essence, the pump assemblies 16*a*–16*b* may be rotated in any desired orientation relative to the corresponding sidewall 18*a*–18*b* of the drive housing 12. Thus, the inlet and outlet lines 154 and 160 may be oriented in the most convenient location for the particular fluid being pumped.

An adjustable stop 31 is used to control the stroke of the piston assembly 24. The stop 31, as most clearly illustrated in FIGS. 1 and 3, includes an elongated shank 180 having a threaded portion 181 rotatably engaged within a threaded cross hole 182 formed in the flange portion 100 of the housing inner member 94. From the cross hole 182, the shank 180 extends upwardly through a slot 183 formed in the housing cover at each handle opening 39. An enlarged, manually graspable head 184 is formed at the distal or upper end of the shank 180, which may be utilized to rotate the stop member. The adjustable stop member 31 further includes a leading end 186 having a frustoconically-shaped tip 188 contoured to closely mate against the rear shoulder 132 of the piston head 118. It will be appreciated that because of the acute angle between the slope of the piston shoulder 132 and the front face 129 of the piston head 118 (angle "x" in FIG. 3), and because the tip 188 of the adjustable stop 31 is shaped to correspond to the slope of the shoulder 132, and further because the adjustable stop is disposed at an angle generally parallel to the piston face 129 (and thus at an acute angle with respect to the piston shoulder 132), the distance within the cross hole 182 that the adjustable stop is advanced or retracted results in a much smaller change in the stroke of the piston assembly 24. This permits the stroke of the piston assembly 24 and, thus, the volumetric flow rate of the pump assembly 16*a* to be precisely metered, especially since the head 184 of the adjustable stop can be rotated about a substantial arc relative to the distance that the adjustable stop is advanced or retracted within the cross hole 182.

Preferably, but not essentially, a micrometer of veneer-type scale, not shown, may be integrated into the construction of the adjustable stop 31 so that the stop can be positioned and later repositioned at desired locations in the cross hole 182 with great accuracy. Also, it is to be understood that a locking mechanism may be employed in conjunction with the adjustable stop 31 to lock the stop at a desired position within the threaded cross hole 182 prior to the tip 188 bottoming against the piston skirt 120 so that the stop does not inadvertently lock the piston 116 with the piston bore 121. This locking mechanism may consist of a circular flange 190 formed along shank 180 at the upper end of the threaded portion 181. As shown in FIG. 3, the lower surface of the flange will bottom against the housing inner member 94 while maintaining clearance between the tip 188 and the piston skirt 120. The circular flange, being of a diameter larger than the width of slot 183, also prevents the accidental disengagement of threaded portion 181 from cross hole 182.

It is to be further understood that the adjustable stop 31 may be adapted to be rotated by an electric stepping motor, not shown, or similar powered device. Further, operation of the stepping motor could be automatically controlled by a sensor, not shown, that monitors various parameters, such as the volumetric flow rate of the pump 10 or the concentration of the fluid being pumped by the pump 10 in the fluid mixture in which such liquid is being introduced. In addition, it is to be appreciated that the "sensitivity" of the adjustable stop 31 may be varied by changing the angle "x" between the rear shoulder 132 of the piston head and the front face of the piston head, with a decrease in this angle resulting in a decrease in the change in the stroke of the piston assembly 24 for a given change in the distance that the adjustable stop 31 is advanced or retracted and vice versa. Further, the "sensitivity" of the adjustable stop 31 may also be changed by altering the angle of approach and reproach of the stop 31 relative to the slope of the rear shoulder 132 of the piston head. As this angle is decreased, for a given distance that the adjustable stop is advanced or retracted relative to the rear shoulder 132, the stroke of the piston assembly 24 is correspondingly decreased.

In the operation of the pump 10, as the eccentric 20 is rotated about the axis 86 by the motor 40, the offset portion 80 of the eccentric rotates about the offset axis 84, which offset axis defines a circle about the axis 86 of a radius equal to the distance separating the axis 84 from the axis 86. As such, the center of the drive roller 22 revolves around this circle while simultaneously rotating about the axis 84. With each revolution of the eccentric 20, the drive roller 22 makes rolling contact with the stem 122 of the piston assembly 24 thereby pushing the piston assembly forwardly against the diaphragm 26 to force the diaphragm against the diaphragm support 27, thereby retracting the diaphragm support in the right-hand direction in FIG. 3. This causes the fluid within the pumping chamber to be forced out through outlet 156. It will be appreciated that the rolling contact between the drive roller 22 and the piston assembly 24 results in very little friction and low stress loads between these components that would be possible if the piston 116 were driven by a member making sliding contact with the stem 122. Also, by the use of the drive roller 22, almost all of the force imparted on the piston stem 122 by the drive roller acts along a vector extending through the center of the drive roller and parallel to the length of the piston assembly 24. Very little of this force acts in a direction transversely to the length of the piston assembly 24 as opposed to if the piston 116 were driven in a conventional manner. As such, not only is the energy of the drive roller efficiency transmitted to the piston assembly 24, but also minimal friction is developed between the exterior of the piston skirt 120 and the piston bore 121. As a result, the components of the present invention, including but not limited to, the housing 12, the pump assemblies **16*a*–16*d*, the eccentric 20, the drive roller 22, the piston assembly 24 and the adjustable stop 31, can be economically manufactured from nonmetallic materials, such as a high-strength plastic, which inherently have low coefficients of friction, thus requiring no lubrication or other maintenance. The only components of the present invention that likely would not be composed of plastic materials are springs, such as spring 125, certain hardware members, such as capscrews 38 and snap ring 68, and bearings, such as roller bearings 60 and 62. Also, the minimal friction drag occurring between the drive roller and the piston assembly and among the other components of the pump 10, in general, enables a smaller drive motor 40** to be utilized to achieve a desired level of fluid flow than is possible in known pump designs.

As the eccentric 20 is further rotated, the drive roller 22 is retracted away from the adjacent end of the piston assembly 24 permitting the piston assembly to be retracted in the left-hand direction as shown in FIG. 3 under the influence of the compression spring 146 acting against the piston support 27. The piston assembly 24 retracts until the rear shoulder 132 of the piston head 122 abuts against the tip 188 of the adjustable stop 31. Because the load imposed by the spring 146 is relatively light, for instance in the range of about 8 to about 10 pounds, the load placed on the tip 188 of the adjustable stop 31 is not of a high level. As such, the tip 188 can be constructed in a fairly small diameter and also there is little likelihood that excessive wear of, or damage to the piston rear shoulder 132 or the stop, will take place when the piston is retracted. During the retraction of the piston assembly, the corresponding movement of the diaphragm 26 in the left-hand direction shown in FIG. 3 results in the intake of the liquid in line 152 through passageway 150, by valve 162 and into the pumping chamber. At the same time, the one-way valve 164 prevents the fluid in the outlet passage 156 from returning to the pumping chamber. The retracted position of the piston assembly 24 and, thus, the displacement volume of the pump assembly 16, may be selectively varied by simply rotating the stop 31.

It is to be appreciated that during the portion of each revolution of eccentric 20 that the drive roller 22 is retracted from the piston assembly 24, the drive roller continues to rotate so that the next time the drive roller is advanced forwardly against a piston assembly, a different section of the outer circumference of the drive roller is placed into rolling contact with the piston assembly. As such, the entire circumference of the drive roller is utilized thereby minimizing the wear on the drive roller and maximizing its useful life.

It also will be appreciated that the roller bearings 60 and 62 utilized to support collar 48 and eccentric 20 may be of a permanently lubricated, sealed design so as not to require periodic lubrication. The roller bearings 82 employed to antifrictionally mount the drive roller 22 on the offset portion 80 of the eccentric 20 may be of the same permanently lubricated, sealed design. As such, the interior of the drive housing 12 is "dry" rather than filled with lubrication for these bearing components and for the drive roller as in typical diaphragm pumps. As a result, if the diaphragm 26 of the present invention were to accidentally rupture, the fluid being pumped will not be contaminated by mixing with such lubricant. Further, minimal heat is generated by the bearings 60, 62 and 82. However, if the housing 12 were filled with lubricant, the sloshing of the lubricant about the interior of the housing would not only generate significant heat, but also the lubricant would somewhat restrict or impede the free movement of the moving components of the pump 10, for instance, the drive roller 22 and the piston assembly 24. Further, although the outer rim portion 108 of the diaphragm 26 is tightly held between the abutting faces of the pump inner and outer housing members 94, 92, respectively, some of the fluid being pumped by the pump assembly 16 may leak past the diaphragm and into the piston chamber. If this occurs, this fluid is drained away from the piston chamber through the drain line 192 to prevent the fluid from accumulating within the piston chamber.

It is to be appreciated that the four pump assemblies **16*a*–16*d* enable four separate, incompatible fluid to be pumped with a single drive roller 32**. Alternatively, two, three or even all four of the pump assemblies can be connected together in series for increased flow of a particular fluid.

Also, although not illustrated, it is to be understood that two or more drive rollers, such as drive rollers 22, may be mounted on a common eccentric that is powered by a single power source, such as drive motor 40. Each of these drive rollers can be utilized to drive a set of up to four pump assemblies. Ideally, the pump assemblies associated with a particular drive roller are rotated relative to the pump assemblies of the other drive roller so that two or more pump assemblies are not being actuated simultaneously. This permits all of the pump assemblies to be operated with a singular, relatively small power source.

As will be apparent to those skilled in the art to which the invention is addressed, the present invention may be embodied in forms other than those specifically disclosed above without departing from the spirit or scope of the present invention. The particular embodiment of the diaphragm pump 10 set forth above is therefore to be considered in all respects as illustrative and not restrictive. The scope of the present invention is as set forth in the appended claims rather than being limited to the example of the pump 10 described in the foregoing description.

The embodiments of the invention in which an exclusive property or privilege is claimed are defined as follows:

1. A high cycle, variable capacity fluid feed pump operable without the need for a source of lubricating fluid, comprising:

(a) a housing, defining an internal chamber;

(b) flexible diaphragm means extending across the internal chamber of the housing to divide the internal chamber into a pumping chamber and a piston chamber, the piston chamber being substantially devoid of lubricating fluid;

(c) a fluid inlet and a fluid outlet in communication with the pumping chamber;

(d) diaphragm support means movably disposed within the pumping chamber to bear against a substantial portion of the adjacent, first face of the diaphragm means;

(e) piston assembly means disposed within the piston chamber to bear against the adjacent, second face of the diaphragm means in opposition to the diaphragm support means;

(f) means for reciprocating the piston assembly means within the piston chamber toward and away from the diaphragm means for pumping fluid through the pumping chamber, the reciprocating means having contact surface means;

(i) said contact surface means cyclically making rolling contact and minimal sliding contact against the piston assembly means when driving the piston assembly means toward the diaphragm; and, (ii) the contact surface means being free of lubricating fluid; and, g) adjustable means for infinitely and precisely adjusting the stroke of the piston assembly means within a given stroke range, said adjustable means cooperating with the piston assembly means to adjust the stroke of the piston assembly means so that during at least part of the time period between the cyclical rolling contacts of the contact surface means against the piston assembly means, the reciprocating means is sufficiently retracted in the direction away from the diaphragm means to space the contact surface means away from the piston assembly means, whereby a different section of the contact surface means is placed in contact with the piston assembly means the next time the reciprocating means drives the piston assembly means toward the diaphragm means.

2. The fluid feed pump according to claim 1, wherein the portion of the diaphragm in contact with the diaphragm support is free of holes and apertures.

3. The fluid feed pump according to claim 1, wherein the diaphragm support includes a major central, planar portion bearing against the diaphragm.

4. The fluid feed pump according to claim 3, wherein the diaphragm support includes a rim portion extending around the major central portion of the diaphragm support and projecting forwardly of the major central portion of the diaphragm support.

5. The fluid feed pump according to claim 4, wherein the piston assembly has an outer rim portion contoured to correspond to the contour of the rim portion of the diaphragm support.

6. The fluid feed pump according to claim 1, wherein:

the pumping chamber defining a substantially circular bore; and, the diaphragm support means is closely and slidably disposed within the pumping chamber to slidably pilot within the bore of the pumping chamber.

7. The fluid feed pump according to claim 1, further including means for resiliently urging the diaphragm support means against the diaphragm means.

8. The fluid feed pump according to claim 1, wherein the piston assembly means includes:

a piston having a head section and an elongate skirt section extending longitudinally along a substantial majority of the length of the piston to slidably reciprocate within a close fitting bore formed in the housing;

a stem; and, means for resiliently interconnecting the stem and piston.

9. The fluid feed pump according to claim 8, wherein:

the piston and the stem of the piston assembly means slidably engage with each other; and, the resilient means are interposed between the piston and the stem of the piston assembly means.

10. The fluid feed pump according to claim 9, wherein the resilient means include spring means.

11. The fluid feed pump according to claim 1, wherein the reciprocating means, comprising:

(a) drive means; and (b) drive means for nominally rotating the drive member means and simultaneously cyclically urging the drive member means against the piston assembly means and push the piston assembly means against the diaphragm means whereupon the drive member means makes rolling contact with the piston assembly means while making dimenimus sliding contact with the piston assembly means, and then retracting the drive member means to be spaced away from the piston assembly means whereupon the drive member means is out of contact from and rotates relative to the piston assembly means and not relative to the drive means so that a different section of a drive member means is next placed into contact with the piston assembly means during the next cycle of the drive means.

12. The fluid feed pump according to claim 11, wherein the portion of the drive member means making contact with the piston assembly means defines a substantially circular shape.

13. The fluid feed pump according to claim 12, wherein the circular drive member means has an outer rim portion means for contacting against the piston assembly means.

14. The fluid feed pump according to claim 13, wherein the drive means moves the center of the drive member means about a circular path.

15. The fluid feed pump according to claim 12, wherein the drive means, comprising:

(a) a rotatable cam; and (b) antifriction bearing means engaged over the rotatable cam disposed within a central portion of the drive member.

16. The fluid feed pump according to claim 15, wherein the cam comprises an eccentric cam.

17. The fluid feed pump according to claim 1, wherein the adjustable means comprising:

(a) a contact surface on the piston assembly means, the contact surface sloped relative to the longitudinal axis along which the piston assembly means reciprocates; and, (b) an adjustable stop member bearing against the contact surface of the piston assembly means, the stop member adjustably positionable relative to the contact surface to control the maximum movement of the piston assembly means in the direction away from the diaphragm means but not limit the movement of the piston assembly means in the direction toward the diaphragm means thereby to uniformly progressively vary the stroke of the piston assembly means.

18. The fluid feed pump according to claim 17, wherein the position of the stop member is controlled by rotation of a threaded member.

19. The fluid feed pump according to claim 18, wherein the stop member is integrally formed with the threaded member, with the stop member constituting the leading end portion of the threaded member.

20. The fluid feed pump according to claim 19, wherein the leading end of the threaded member is in the shape of a frustoconical tip of the threaded member.

21. The fluid feed pump according to claim 17, wherein the stop member is disposed at an acute angle of approach and reproach relative to the contact surface of the piston.

22. The fluid feed pump according to claim 1, wherein:

(a) the housing defining a plurality of internal chambers;

(b) the flexible diaphragm means extending across each internal chamber to divide each internal chamber into a pumping chamber and a piston chamber, the piston chambers being substantially devoid of lubricating fluid;

(c) a fluid inlet and outlet is in communication with each pumping chamber;

(d) the diaphragm support means are movably disposed within each pumping chamber to bear against a substantial portion of the adjacent, first face of the diaphragm means;

(e) the piston assembly means are disposed within each piston chamber to bear against the adjacent, second face of the corresponding diaphragm means in opposition to the diaphragm support means; and (f) the reciprocating means sequentially reciprocating each piston assembly means; and, (g) the contact surface means of the reciprocating means making rolling contact with no more than one piston assembly means at a time.

23. The fluid feed pump according to claim 22, wherein the contact surface means of the reciprocating means being momentarily spaced away from all of the piston assembly means after completion of a rolling contact with a particular piston assembly means.

24. A high cycle, variable capacity fluid feed pump operable without the need for a source of lubricating fluid, comprising:

(a) a housing defining an internal chamber;

(b) flexible diaphragm means extending across the internal chamber of the housing to divide the internal chamber into a pumping chamber and a piston chamber, the piston chamber being substantially devoid of lubricating fluid;

(c) a fluid inlet ad a fluid outlet in communication with the pumping chamber;

(d) diaphragm support means movably disposed within the pumping chamber for bearing against a substantial portion of the adjacent, first face of the diaphragm means;

(e) piston assembly means disposed within the piston chamber to bear against the adjacent, second face of the diaphragm means in opposition to the diaphragm support means;

(f) means for reciprocating the piston assembly means within the piston chamber toward and away from the diaphragm means for pumping fluid through the pumping chamber, the reciprocating means having contact surface means cyclically making rolling contact and minimal sliding contact against the piston assembly means when driving the piston assembly means toward the diaphragm;

(g) adjustable means for infinitely and precisely adjusting the stroke of the piston assembly means within a given stroke range, the adjustable means comprising:

(i) a contact surface on the piston assembly means, the contact surface sloped relative to the longitudinal axis along which the piston assembly means reciprocates;

(ii) an adjustable stop member bearing against the contact surface of the piston assembly means, the stop member adjustably positionable relative to the contact surface to control the maximum movement of the piston assembly means in the direction away from the diaphragm means but not limit the movement of the piston assembly means in the direction toward the diaphragm means thereby to uniformly progressively vary the stroke of the piston assembly means; and, (iii) said adjustable stop member cooperatively bearing against the contact surface of the piston assembly means to space the piston assembly means away from reciprocating means contact surface means between sequential rolling contact of the reciprocating means with the piston assembly means to enable a different section of the contact surface means to be placed in contact with the piston assembly means the next time the reciprocating means drives the piston assembly means toward the diaphragm means; and, (h) wherein the piston assembly means includes an enlarged head adjacent the diaphragm means, a portion of the head serves as the sloped contact surface, and elongate skirt means receivable within a close fitting bore formed in the housing to guide the piston assembly during reciprocating movement.

25. The fluid feed pump according to claim 24, wherein the head of the piston assembly means includes a forward portion toward the diaphragm means and a rearward portion facing away from the diaphragm means, and wherein the sloped contact surface is located on the rearward portion of the head of the piston assembly means.

26. The fluid feed pump according to claim 25, wherein the rearward portion of the head of the piston assembly means that constitutes the sloped contact surface is frustoconically-shaped and extends diametrically outwardly to substantially the maximum diameter of the head of the piston assembly means and diametrically inwardly to substantially the diameter of the skirt means of the piston assembly means.

27. The fluid feed pump according to claim 22, wherein the piston means assembly is allowed to rotate about its longitudinal axis to present substantially the entire frustoconical contact surface of the head of the piston means assembly to the stop member as the contact surface of the piston means assembly.

28. The fluid feed pump operable without the need for a source of lubricating fluid, comprising:

(a) a pumping chamber;

(b) a fluid inlet and a fluid outlet in communication with the pumping chamber;

(c) reciprocable pumping means for pumping fluid through the pumping chamber, the pumping means having a first, forward section in communication with the pumping chamber and a second, rearward section extending outwardly from the pumping chamber;

(d) drive roller means;

having a contact perimeter substantially aligned with the rearward section of the pumping means;

having an inside mounting diameter substantially smaller than the contact perimeter; and, wherein the contact perimeter is free of lubricating fluids; and, (e) power means engagable with the inside mounting diameter of the drive roller means:

said power means initially rotating and simultaneously cyclically advancing the drive roller means to place its contact perimeter in rolling contact and minimal sliding contact with the rearward section of the pumping means for advancing the pumping means toward the pumping chamber; and, said power means subsequently withdrawing the drive roller means away from the rearward section of the pumping means thereby to position the contact perimeter of the drive roller means spaced away from the rear section of the pumping means, whereupon with the next advancement of the power means a different portion of the contact perimeter of the drive roller means is placed into rolling contact with the rearward section of the pumping means.

29. The fluid feed pump according to claim 28, wherein the power means moves the center of the drive roller means about a circular path.

30. A fluid feed pump according to claim 29, wherein the power means includes:

(a) an antifriction bearing means secured to the inside mounting diameter of the drive roller means at a location centrally relative to the contact perimeter; and, (b) a rotatable, eccentric cam engaged with the center portion of the antifriction bearing means.

31. The fluid feed pump according to claim 28, wherein the contact perimeter of the drive roller means includes the rim of the drive roller.

32. The fluid feed pump according to claim 28, wherein the contact perimeter of the drive roller means is circular.

33. The fluid feed pump according to claim 28, further comprising means for precisely and infinitely adjusting the stroke of the pumping means within a given stroke range by controlling the retracted position of the pumping means and not hindering the movement of the pumping means toward the pumping chamber.

34. The fluid feed pump according to claim 28, further comprising biasing means structurally independent from the pumping means to return the pumping means towards the drive roller means as the drive roller means retracts.

35. The fluid pump operable without the need for a source of lubricating fluid, comprising:

(a) a pumping chamber;

(b) a fluid inlet and a fluid outlet in communication with the pumping chamber;

(c) a reciprocable pumping means for pumping fluid through the pumping chamber, the pumping means having a first, forward section in communication with the pumping chamber and a second, rearward section extending outwardly from the pumping chamber;

(d) drive roller means having a contact perimeter substantially aligned with the rearward section of the pumping means and an inside mounting diameter substantially smaller than the contact perimeter;

(e) power means engagable with the inside mounting diameter of the drive roller means for: simultaneously rotating and cyclically advancing the drive roller means to place its contact perimeter in rolling contact and minimal sliding contact with the rearward section of the pumping means to move the pumping means toward the pumping chamber; subsequently withdrawing the drive roller means away from the rearward section of the pumping means;

(f) means for precisely and infinitely adjusting the stroke of the pumping means within a given stroke range by controlling the retracted position of the pumping means and not hindering the movement of the pumping means toward the pumping chamber; and, (g) wherein the means for precisely adjusting the stroke of the pumping means includes:

a ramp surface on the pumping means and disposed at an obtuse angle relative to the direction of reciprocating movement of the pumping means; and, a selectively adjustable stop member means abutting against the ramp surface to: (i) control the return stroke of the pumping means and space the drive roller means away from the rearward section of the pumping means when the power means withdraws the drive roller means whereupon with each cycle of the power means a different portion of the contact perimeter of the drive roller means is placed into rolling contact with the rearward section of the pumping means; and, (ii) permit rotation of the ramp surface about the longitudinal axis of the pumping means, the stop member means being movable relative to the ramp surface at an acute angle relative to the plane of the ramp surface.

36. The fluid feed pump according to claim 35, wherein the pumping means includes a piston having an enlarged head portion, the enlarged head portion serving as the ramping surface of the adjustable means.

37. The fluid feed pump according to claim 36, wherein the enlarged head portion of the piston includes a forward face and a rearward frustoconically-shaped surface constituting the ramp surface.

38. The fluid feed pump according to claim 33, wherein the ramp surface is of a substantially constant slope.

39. The fluid feed pump according to claim 35, wherein the stop member includes a contact surface disposed substantially parallel to the slope of the ramp surface.

40. The fluid feed pump according to claim 39, wherein the contact surface of the stop member is substantially conically shaped.

41. The fluid feed pump according to claim 39, wherein the selectively adjustable stop member advances and retracts a contact surface of the stop member relative to the ramp surface by rotation of the threaded member.

42. The fluid feed pump according to claim 41, wherein the contact surface of the stop member is disposed on the forward end of a lead screw.

43. The fluid feed pump according to claim 42, wherein the forward end of the lead screw is conically shaped.

44. A fluid feed pump, comprising:

(a) a pumping chamber;

(b) a fluid inlet and outlet in communication with the pumping chamber;

(c) a flexible diaphragm extending across the pumping chamber;

(d) reciprocable piston means having head means bearing against the diaphragm for pumping fluid through the pumping chamber and elongate skirt means for guiding the piston means during reciprocating movement along the longitudinal axis of the piston means to advance the piston means towards the diaphragm means and retract the piston means from the diaphragm means;

(e) drive means making cyclical rolling contact with the piston means to advance the piston means toward the diaphragm means and retract the piston means from the diaphragm means;

(f) adjustable means for precisely and infinitely adjusting the stroke of the piston means along a finite stroke range by limiting the retraction of the piston means, the adjustable means comprising a ramp surface on the head means of the piston means, the ramp surface disposed at an acute angle relative to the plane of the diaphragm, selectively adjustable stop member means for bearing against the ramp surface, and adjustable means for moving the stop member means relative to the ramp surface in a direction of approach and reproach that is at an acute angle from the plane of the ramp surface; and, (g) wherein the stop member by cooperatively bearing against the ramp surface limiting the retraction of the piston means to space the drive means from the piston means during each cycle of the drive means so that a different section of the drive means makes rolling contact with the piston means.

45. The fluid feed pump according to claim 44, wherein the adjustable means include a threaded member oriented relative to the ramp surface whereby the distance of movement of the stop member means resulting from rotation of the threaded member is greater than the corresponding change in the stroke of the piston.

46. The fluid feed pump according to claim 43, wherein the stop member means has a contact surface bearing against the ramp surface, the contact surface being substantially parallel to the ramp surface.

47. The fluid feed pump according to claim 44, wherein the ramp surface is incorporated into the shape of the piston head means.

48. The fluid feed pump according to claim 47, wherein the ramp surface is incorporated into the external contour of the piston head means.

49. The fluid feed pump according to claim 47, wherein the piston head means having a forward portion facing toward the diaphragm and a rearward portion facing away from the diaphragm, and wherein the ramp surface is located on the rearward portion of the piston head means.

50. A fluid feed pump, comprising:

(a) a pumping chamber;

(b) a fluid inlet and outlet in communication with the pumping chamber;

(c) a flexible diaphragm extending across the pumping chamber;

(d) reciprocable piston means having head means bearing against the diaphragm for pumping fluid through the pumping chamber and elongate skirt means for guiding the piston means during reciprocating movement along the longitudinal axis of the piston means to advance the piston means toward the diaphragm means and retract the piston means from the diaphragm means;

(e) adjustable means for precisely and infinitely adjusting the stroke of the piston means along a finite stroke range by limiting the retraction of the piston means, the adjustable means comprising a ramp surface associated with the piston head means, the ramp surface disposed at an acute angle relative to the plane of the diaphragm, selectively adjustable stop member means for bearing against the ramp surface, and adjustable means for moving the stop member means relative to the ramp surface in a direction of approach and reproach that is at an acute angle from the plane of the ramp surface; wherein the ramp surface is incorporated into the external contour of the piston head means;

(f) wherein the piston head means having a forward portion facing toward the diaphragm means and a rearward portion facing away from the diaphragm means, and wherein the ramp surface is located on the rearward portion of the piston head means; and, (g) wherein the rearward portion of piston head means constituting the ramp surface is frustoconically shaped.

51. The fluid feed pump according to claim 50, wherein the adjustable means includes a lead screw disposed at an acute angle relative to the slope of the ramp surface and the stop member means is incorporated into the tip of the lead screw.

52. The fluid feed pump according to claim 51, wherein the tip of the lead screw is frustoconically shaped.

53. The fluid feed pump according to claim 52, wherein the sloe of the frustoconically-shaped tip of the lead screw is disposed substantially parallel to the slope of the frustoconically-shaped ramp surface.

* * * * *

UNITED STATES PATENT AND TRADEMARK OFFICE

CERTIFICATE OF CORRECTION

PATENT NO. : 5,044,891

DATED : September 3, 1991

INVENTOR(S) : Ken Ozawa

It is certified that error appears in the above-identified patent and that said Letters Patent is hereby corrected as shown below:

| COLUMN | LINE | |
|---|---|---|
| 3 | 67 | "with" should be --within-- |
| 4 | 60 | "advance" should be --advantage-- |
| 8 | 63 | "effective" should be --effectively-- |
| 9 | 2 | "passageways 15" should be --passageways 150-- |
| 11 | 31 | "efficiency" should be --efficiently-- |
| 12 | 5 | "passage 156" should be --passageway 156-- |
| 13 | 62 | after "diaphragm" insert --means-- |
| 13 | 62 | after "support" insert --means-- |
| 13 | 64 | after "support" insert --means-- |
| 13 | 65 | after "diaphragm" insert --means-- |
| 14 | 4 | after "assembly" insert --means-- |
| 14 | 6 | after "support" insert --means-- |
| 14 | 35 | after "drive" insert --member-- |
| 14 | 39 | "and push" should be --to push-- |
| 14 | 42 & 43 | "dimeni-mus" should be --deminimus-- |
| 14 | 67 | after "cam" insert --and-- |
| 16 | 3 | "ad" should be --and-- |
| 16 | 59 | after "portion" insert --facing-- |
| 17 | 4 | "Claim 22" should be --Claim 26-- |
| 17 | 5 | after "assembly" insert --means-- |
| 17 | 8 | after "assembly" insert --means-- |
| 17 | 9 | after "assembly" insert --means-- |

UNITED STATES PATENT AND TRADEMARK OFFICE

CERTIFICATE OF CORRECTION

PATENT NO. : 5,044,891

DATED : September 3, 1991

INVENTOR(S) : Ken Ozawa

It is certified that error appears in the above-identified patent and that said Letters Patent is hereby corrected as shown below:

Column 18, line 8, "the fluid" should be --A fluid--
Column 18, line 13, after "(c)" delete "a"
Column 19, line 1, "Claim 33" should be Claim 35--
Column 19, line 33, "towards" should be --toward--
Column 20, line 1, "Claim 43" should be --Claim 45--
Column 20, line 62, "sloe" should be --slope--

Signed and Sealed this

Twenty-fifth Day of May, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,044,891

DATED : September 3, 1991

INVENTOR(S) : Ken Ozawa

It is certified that error appears in the above-indentified patent and that said Letters Patent is hereby corrected as shown below:

| COLUMN | LINE | |
|---|---|---|
| 3 | 67 | "with" should be --within-- |
| 4 | 60 | "advance" should be --advantage-- |
| 8 | 63 | "effective" should be --effectively-- |
| 9 | 2 | "passageways 15" should be --passageways 150-- |
| 11 | 31 | "efficiency" should be --efficiently-- |
| 12 | 5 | "passage 156" should be --passageway 156-- |
| 13 | 62 | after "diaphragm" insert --means-- |
| 13 | 62 | after "support" insert --means-- |
| 13 | 64 | after "support" insert --means-- |
| 13 | 65 | after "diaphragm" insert --means-- |
| 14 | 4 | after "assembly" insert --means-- |
| 14 | 6 | after "support" insert --means-- |
| 14 | 35 | after "drive" insert --member-- |
| 14 | 39 | "and push" should be --to push-- |
| 14 | 42 & 43 | "dimeni-mus" should be --deminimus-- |
| 14 | 67 | after "cam" insert --and-- |
| 16 | 3 | "ad" should be --and-- |
| 16 | 59 | after "portion" insert --facing-- |
| 17 | 4 | "Claim 22" should be --Claim 26-- |
| 17 | 5 | after "assembly" insert --means-- |
| 17 | 8 | after "assembly" insert --means-- |
| 17 | 9 | after "assembly" insert --means-- |

UNITED STATES PATENT AND TRADEMARK OFFICE

CERTIFICATE OF CORRECTION

PATENT NO. : 5,044,891

DATED : September 3, 1991

INVENTOR(S) : Ken Ozawa

It is certified that error appears in the above-indentified patent and that said Letters Patent is hereby corrected as shown below:

| COLUMN | LINE | |
|---|---|---|
| 18 | 8 | "the fluid" should be --A fluid-- |
| 18 | 13 | after "(c)" delete "a" |
| 19 | 1 | "Claim 33" should be --Claim 35-- |
| 19 | 5 | after "member" insert --means-- |
| 19 | 9 | after "member" insert --means-- |
| 19 | 12 | after "member" insert --means-- |
| 19 | 13 & 14 | after "member" insert --means-- |
| 19 | 17 | after "member" insert --means-- |
| 19 | 33 | "towards" should be --toward-- |
| 20 | 1 | "Claim 43" should be --Claim 45-- |
| 20 | 62 | "sloe" should be --slope-- |

This Certificate supersedes Certificate of Correction issued May 25, 1993.

Signed and Sealed this

First Day of March, 1994

Bruce Lehman

*Attest:*

BRUCE LEHMAN

*Attesting Officer*

*Commissioner of Patents and Trademarks*